United States Patent [19]

Neuenschwander

[11] 4,176,427

[45] Dec. 4, 1979

[54] WEB FORMING APPARATUS EMPLOYING SPREADING SECTION

[75] Inventor: Rudolf Neuenschwander, Swarthmore, Pa.

[73] Assignee: Scott Paper Company, Philadelphia, Pa.

[21] Appl. No.: 930,175

[22] Filed: Aug. 2, 1978

[51] Int. Cl.[2] ..... D04H 1/00

[52] U.S. Cl. ..... 19/306; 19/307; 425/82.1; 425/83.1

[58] Field of Search ..... 19/88, 89, 304, 306, 19/307, 308; 264/121, 518; 28/103; 425/82.1, 83.1; 65/9

[56] References Cited

U.S. PATENT DOCUMENTS

| | | | |
|---|---|---|---|
| 2,023,273 | 12/1935 | Lequillon | 425/82.1 X |
| 3,728,872 | 4/1973 | Thore | 19/308 X |
| 3,753,271 | 8/1973 | McBean | 19/306 X |
| 3,961,397 | 6/1976 | Neuenschwander | 19/306 X |
| 4,065,832 | 1/1978 | Neuenschwander | 19/306 |

*Primary Examiner*—Robert R. Mackey

*Attorney, Agent, or Firm*—Martin L. Faigus; William J. Foley

[57] ABSTRACT

An apparatus for increasing the width, or cross-machine-direction dimension of a fluid-entrained (e.g. air-entrained) stream of fibers prior to depositing the fibers on a foraminous forming surface to form a fibrous web structure. A rotatable spreading roll intercepts the open downstream end of a conveying duct through which the fluid-entrained stream of fibers is directed, and this roll includes a plurality of axially spaced disks providing flow-directing channels between them. The rotational axis of the spreading roll is oriented obliquely to the duct so that the lateral dimension of flow-directing channels between laterally spaced-apart duct sidewalls is greater than the width of the duct at its open downstream end, as measured generally normal to the direction of fiber flow through the duct.

6 Claims, 5 Drawing Figures

Fig. 1
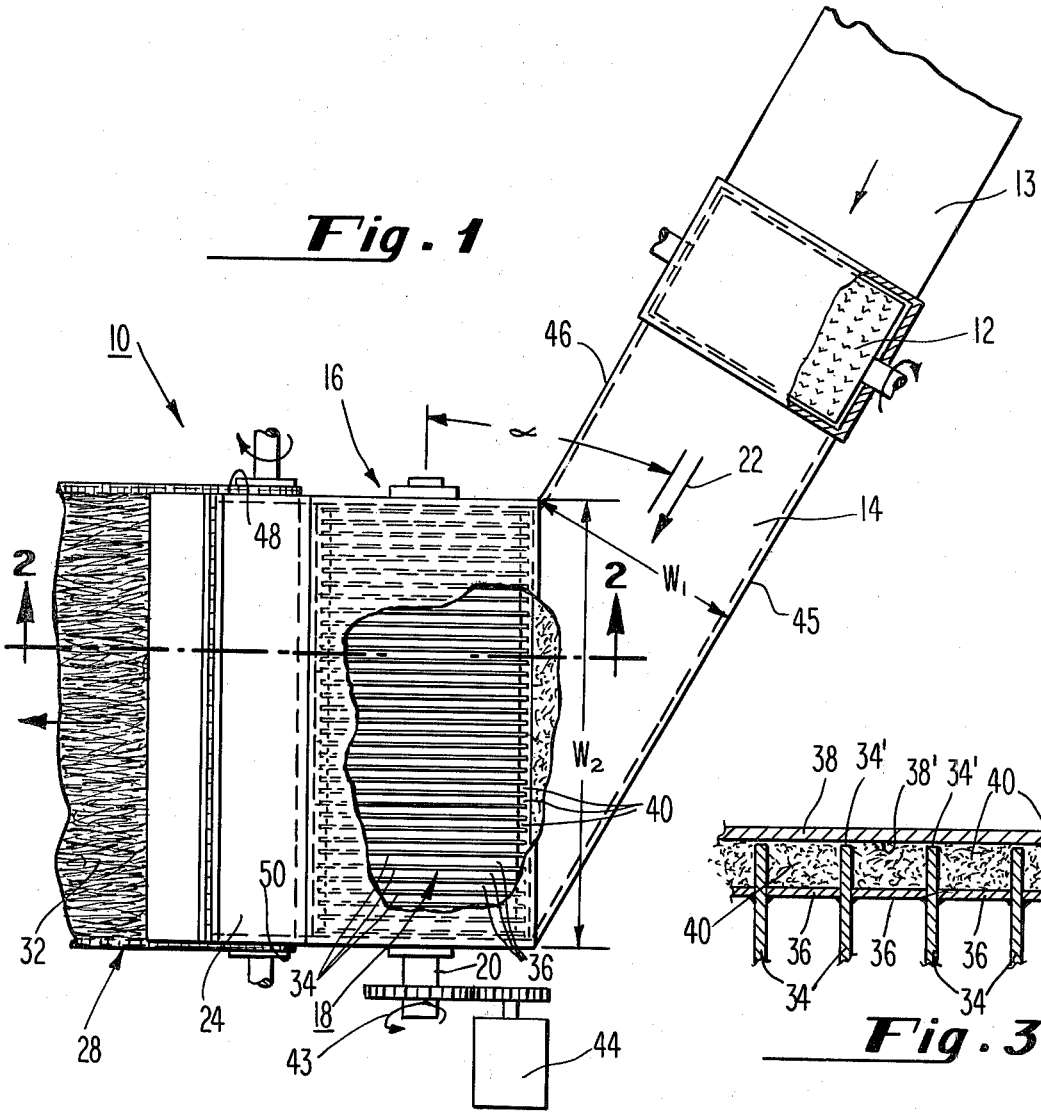
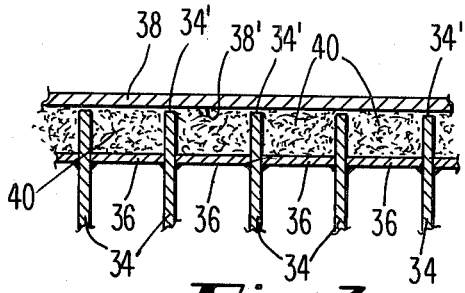
Fig. 3
Fig. 2
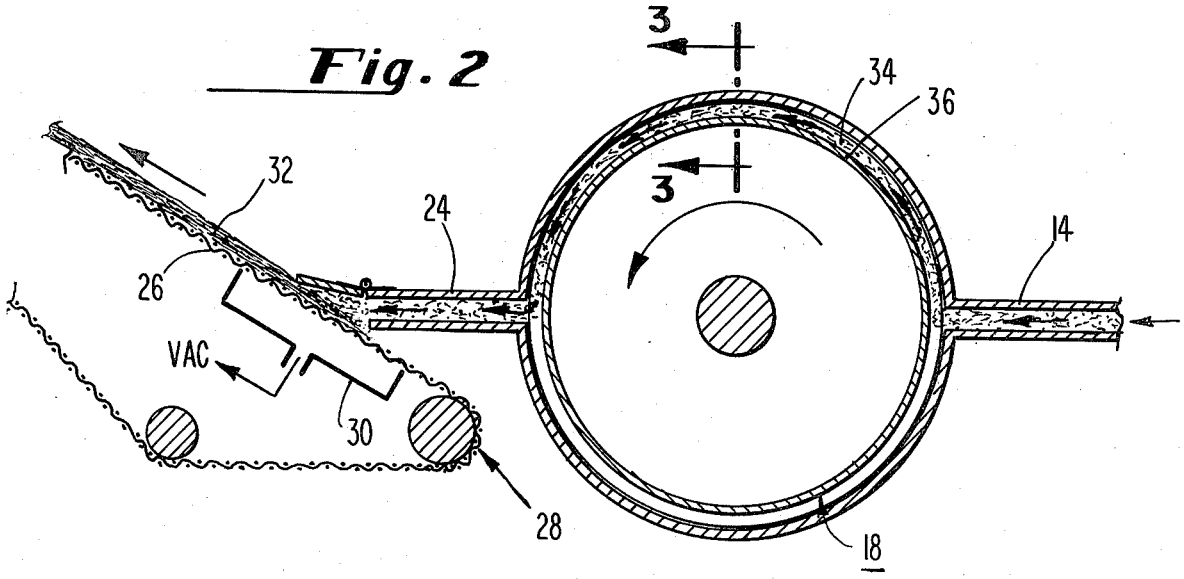

WEB FORMING APPARATUS EMPLOYING SPREADING SECTION

TECHNICAL FIELD

This invention relates generally to an apparatus for forming a fibrous structure from a stream of fluid-entrained fibers, and more particularly, to an apparatus for laterally spreading the stream prior to forming the fibrous structure.

Reference throughout this application, including the claims, to "fibrous structure" or "fibrous web" is not intended to be limited to any particular basis weight range, and in fact, is intended to refer to both low basis weight structures less than about 6 oz./yd.$^2$ and considerably heavier structures that are often referred to as "mats" or "batts".

BACKGROUND ART

In both wet-lay and air-lay operations, fibrous webs are formed by depositing fibers from a fluid stream onto a foraminous forming surface. In commercial installations, it is highly desirable to increase product output to thereby minimize the unit cost of manufacturing, and this is particularly important when manufacturing single and limited use fibrous products, such as cosmetic pads, industrial towels, household towels, facial tissues, impregnated wipes, components of disposable diapers and sanitary napkins, etc. These products must be economically manufactured so that they can be sold profitably at a price that is low enough to justify their frequent disposal.

One way of increasing production output in a web forming line is to form the fibrous web several times wider than that of the final product, and thereafter sever the web in laterally spaced-apart regions to form several web sections from which the product can be formed. This techinque can be very advantageously employed in the formation of single and limited use air-lay products that are intended to compete with products made by faster, wet-lay processes.

One approach to forming wide webs is disclosed and claimed in U.S. Pat. No. 4,065,832, issued to Rudolf Neuenschwander, and assigned to Scott Paper Company. The preferred apparatus disclosed in this patent includes a foraminous forming surface obliquely oriented to the direction of fiber flow through a conveying duct and intercepting the downstream end of said duct, whereby the lateral dimension of the foraminous surface between laterally spaced-apart duct sidewalls is greater than the width of the duct at its open downstream end, as measured in a direction generally normal to the direction of fiber flow through the duct. This oblique orientation establishes an acute angle $\alpha$ between one of the duct sidewalls and the forming run of the foraminous member, as is clearly shown in FIG. 1. This angular relationship provides a restriction adjacent the edge of the forming surface to cause the formation of a thin edge; especially in thick web structures. If the thin edge is not tolerable in the finished product it must be removed from the formed web; thereby resulting in production inefficiency. Thus, the apparatus disclosed in the U.S. Pat. No. 4,065,832 is not sufficiently versatile to form webs with a substantially uniform thickness from edge to edge over a wide range of basis weights.

DISCLOSURE OF INVENTION

In accordance with this invention, an apparatus is provided for fluid-forming (e.g. air-forming) a fibrous web by increasing the width, or cross-machine-direction dimension of a stream of fluid-entrained fibers prior to directing the fibers onto a web-forming surface.

The apparatus of this invention includes a conveying duct for receiving a fluid-entrained stream of fibers at its upstream end, a rotatable spreading roll positioned to intercept an open downstream end of the conveying duct and including a plurality of axially spaced-apart disks providing flow-directing channels between them for receiving the fluid-entrained stream of fibers, said spreading roll being obliquely oriented to the direction of flow through the duct so that the lateral dimension of the roll intercepting the duct is greater than the width of the downstream end of the duct, as measured in a direction generally normal to the direction of fiber flow through the duct, whereby the flow-directing channels of the spreading roll will receive the fluid-entrained fiber flow as it moves in its path of travel through the conveying duct to increase the width of the flow, and thereafter, will divert the flow prior to directing the fibers thereof onto a web forming surface, and drive means for rotating the spreading roll to aid in preventing the build up of fibers in the flow-directing channels and about the edges of the spaced-apart disks.

The present invention resides in a unique system for both diverting the flow of fluid-entrained fibers and increasing its lateral dimension prior to directing the expanded flow onto a web forming surface. As a result of this invention, the expanded flow can be directed onto the forming surface to form a wide web without the necessity of obliquely orienting the forming surface to the direction of fiber flow. This permits formation of the web without restricting the flow of fibers at the edges to thereby permit the formation of both low and heavy basis weight structures without thin edges. Moreover, as explained earlier, the rotation of the spreading roll aids in preventing the fibers in the air-stream from blocking the flow-directing channels; thereby minimizing "downtime" necessary to clean out the apparatus.

Other objects and a fuller understanding of the invention will be had by referring to the following description and claims directed to the best modes for carrying out this invention, taken in conjunction with the accompanying drawings.

BRIEF DESCRIPTION OF DRAWINGS

FIG. 1 is a schematic plan view of an apparatus of this invention with parts broken away to show details of construction;

FIG. 2 is a sectional view taken along line 2—2 of FIG. 1;

FIG. 3 is a sectional view taken along line 3—3 of FIG. 2 and showing details of a unique flow spreading assembly of this invention;

BEST MODES FOR CARRYING OUT THE INVENTION

Figure 4:
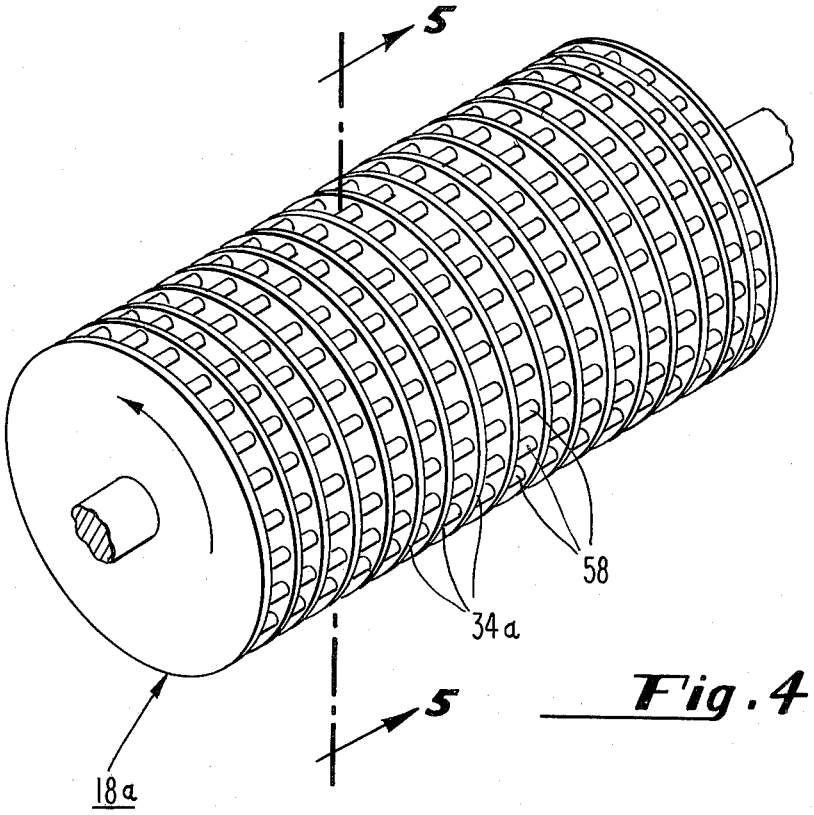
FIG. 4 is an isometric view of an additional embodiment of a flow spreading roll in accordance with this invention.

Referring specifically to FIG. 1, the preferred embodiment of this invention is an air-lay apparatus 10 including a fiberizing roll 12 for separating fibers from a feed mat or sheet 13, and directing the separated fibers in an air stream through a first conveying duct 14. These features can be identical to those disclosed in U.S. Pat. No. 4,065,832, issued on Jan. 3, 1978 to Rudolf Neuenschwander, and herein incorporated by reference.

In accordance with this invention, the conveying duct 14 is intercepted by a unique spreading assembly 16 including a spreading roll 18 secured to a rotatably mounted axle 20 oriented at an oblique angle $\alpha$ to the general direction of fiber flow through the duct 14. This general direction of flow is indicated by the arrow 22, and is substantially parallel to the longitudinal axis of the duct 14.

Referring to FIGS. 1 and 3, the spreading assembly 16 also communicates with the upstream end of a second conveying duct 24, and the downstream end of said second duct is intercepted by the web forming run 26 of a foraminous conveyor 28. A vacuum box 30 is positioned beneath the forming run 26 in alignment with the second duct 24. The air-suspension of fibers is directed through the first conveying duct 14, the spreading assembly 16 (in which the flow is both turned and spread), and the second conveying duct 24 by establishing a pressure differential across the apparatus 10. This is achieved in a conventional manner by directing the air employed to entrain the fibers, under positive pressure, into the upstream end of the conveying duct 14 with a fan or other suitable blower (not shown), and by maintaining the downstream end of the apparatus 10 at a lower pressure than the upstream end. As illustrated, the downstream end of the apparatus is exposed to a slight suction force through the vacuum box 30 to aid in guiding the air stream of fibers toward the forming run 26 to deposit fibers on said forming run in the form of a fibrous web 32. The air from the stream is received in the vacuum box 30 and can either be disposed of or recycled, as desired.

As can be seen best in FIG. 1, the width of the fibrous web 32 formed on the conveyor 28 is greater than the width of the air suspended fibers carried through the duct 14, and this result is achieved by employing the unique spreading assembly 16 in accordance with this invention.

Referring specifically to FIGS. 1-3, the spreading roll 18 is provided with a plurality of axially spaced-apart circular disks 34 along the axle 20, and these disks are maintained in their spaced-apart relationship by cylindrical spacers 36. The roll 18 is mounted within a housing 38 closely spaced to the outer periphery of the circular disks 34. Most preferably, the inner surface 38' of the housing is spaced less than 1/16 inch from the outer periphery 34' of the disks 34 to minimize cross-current flow between flow-directing channels 40 provided between the spaced-apart disks. These channels 40 are disposed along substantially the entire axial extent of the roll 18, and intercept the flow of air-suspended fibers through the duct 14 to spread the flow, and also to divert it into the second duct 24 (FIG. 1). Moreover, the roll 18 is rotated in the direction of arrow 43 by a drive motor 44 to prevent, or minimize the likelihood of fibers either building-up across the outer periphery 34' of the disks 34, or otherwise clogging the channels 40. This minimizes downtime required to clean out the apparatus.

Referring to FIG. 1, the width, $W_1$, of the downstream end of the conveying duct is the distance between laterally spaced-apart sidewalls 45 and 46, as measured generally normal to the direction of material flow through said duct. This duct width is less than the axial dimension, $W_2$, of the section of roll 18 between the duct sidewalls 45 and 46, and this axial dimension is calculated by the following formula:

$$W_2 = W_{1/\text{sine } \alpha}$$

wherein: $W_1$ is the width of the conveying duct 14 adjacent its downstream end, as measured between the laterally spaced-apart sidewalls 45 and 46 in a direction generally normal to the direction of material flow through the duct 14; and $\alpha$ is the included angle between the axle of the spreading roll 18 and the general direction of material flow through the duct 14.

In the preferred embodiment of this invention, the second conveying duct 24 has a width, between substantially parallel sidewalls 48 and 50, that is substantially equal to the lateral dimension $W_2$ of the roll 18. Accordingly, the stream of fibers directed through the duct 24 will form a fibrous web 32 that also has a width substantially equal to $W_2$. However, within broader aspects of this invention the sidewalls 48 and 50 can either slightly diverge or slightly converge in a direction toward the conveyor 28, or alternatively, the second conveying duct 24 can be omitted and the widened stream of fibers from the channels 40 in the roll 18 can be directed through an unconfined flow path onto the conveyor 28.

In the preferred embodiment of this invention, the laterally spaced-apart duct sidewalls 45 and 46 of the first conveying duct 14 are symmetrically disposed on opposite sides of a central duct axis, and preferably are parallel to each other. In this embodiment of the invention, the angle $\alpha$ can be measured between the axle 20 of the roll 18, and the central axis of the duct 14, or a line parallel to said central axis.

Figure 5:
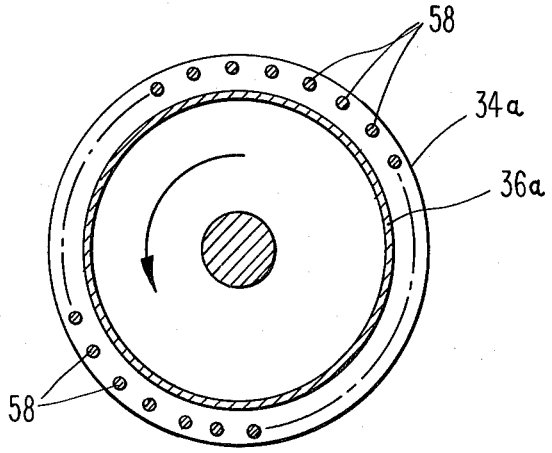
FIG. 5 is a sectional view taken along line 5—5 of FIG. 4.

In some instances the fibers within the first conveying duct 14 tend to "ball-up" or agglomerate into entangled fiber masses, and these masses can be conveyed through the apparatus and ultimately be included in the finished web structure. This can undesirably detract from the physical and aesthetic properties that are either necessary, or desired in the web structure. To overcome this problem, a modified spreading roll 18*a* of the type shown in FIGS. 4 and 5 can be employed to spread the air-entrained fiber flow. Specifically, the spreading roll 18*a* includes a plurality of spaced-apart circular disks 34*a* and cylindrical spacers 36*a*. The spacers 36*a* are identical to the spacers 36 shown in FIGS. 1-3; however, the disks 34*a* are modified to include a plurality of circumferentially spaced-apart passages, and the passages in adjacent disks are axially aligned to receive a plurality of axially extending, circumferentially spaced-apart disperser rods 58. In operation, the air-entrained fibers directed through the conveying duct 14 initially impinge upon the periphery of the roll 18*a*, and encounter the physical impediment provided by the disperser rods. These rods tend to create turbulent flow conditions, and also mechanically beat the air entrained fibers to break up loosely formed agglomerates prior to the flow being directed into the second conveying duct 24, and ultimately onto the web-forming conveyor.

Although the invention has been described with a certain degree of particularity, it is understood that the present disclosure has been made only by way of example and that numerous changes in the details of construction and in the combination and arrangement of parts may be restored to without departing from the scope of the invention.

Having described my invention I claim:

1. An apparatus for increasing the width of a fluid-entrained stream of fibers, said apparatus comprising: a conveying duct including laterally spaced-apart sidewalls, said duct having an upstream end for receiving the fluid-entrained stream of fibers and a downstream end toward which the stream is directed; a rotatable spreading roll having a plurality of axially spaced-apart disks providing flow-directing channels between them and intercepting the downstream end of the duct between the laterally spaced-apart sidewalls, the rotational axis of the spreading roll being obliquely oriented to the direction of flow through the conveying duct to present an axial dimension between the spaced-apart duct sidewalls that is greater than the width of the duct at its open downstream end, as measured between said duct sidewalls in a direction generally normal to the direction of fiber flow through the duct; whereby the flow of fluid-entrained fibers is received in the channels over a greater width than the duct width, is diverted by moving through the channels, and is thereafter released from the channels as a stream of fluid-entrained fibers wider than the stream in the conveying duct; and drive means for rotating the spreading roll.

2. The apparatus of claim 1 including a second conveying duct having an upstream end for receiving the fluid-entrained stream of fibers released from the spreading roll, and 9 downstream end intercepted by a moving foraminous surface upon which fibers from the stream are deposited and through which the fluid of the stream is passed.

3. The apparatus of claim 1 including a housing about the spreading roll, said housing including a first passage for receiving the fluid-entrained stream of fibers from the conveying duct, and a second passage through which the fluid-entrained stream of fibers passes when it is released from the spreading roll, said housing being closely spaced to the outer periphery of the spaced-apart disks to minimize cross-flow of fluid between channels.

4. The apparatus of claim 1 including spacer means for maintaining the axial spacing between the disks of the spreading roll, said spacer means having substantially cylindrical outer surfaces spaced inwardly from the outer periphery of the disks.

5. The apparatus of claim 1, including clump disperser means bridging the channels for intercepting the fluid-entrained stream of fibers to break up clumps of fibers.

6. The apparatus of claim 5 wherein the clump disperser means include a plurality of axially extending rod means spaced circumferentially about the spreading roll, each rod extending through axially aligned passages in the axially spaced-apart disks.

* * * * *